United States Patent [19]

Campbell

[11] 4,295,822

[45] Oct. 20, 1981

[54] PRODUCER GAS FUELED BURNER SYSTEM AND DRYING APPARATUS

[76] Inventor: Crom B. Campbell, 222 Glenview Dr., Des Moines, Iowa 50312

[21] Appl. No.: 80,207

[22] Filed: Oct. 1, 1979

[51] Int. Cl.[3] ..... F24H 1/00

[52] U.S. Cl. ..... 432/29; 110/204; 110/252; 431/9

[58] Field of Search ..... 431/9; 110/102, 204, 110/242, 252; 98/62, 79; 432/29, 223

[56] References Cited

U.S. PATENT DOCUMENTS

| | | | |
|---|---|---|---|
| 2,110,209 | 3/1938 | Engels . | |
| 3,511,194 | 5/1970 | Stookey . | |
| 3,565,051 | 2/1971 | Swift . | |
| 3,586,301 | 6/1971 | Shipp et al. . | |
| 3,861,334 | 1/1975 | Stockman | 110/204 |
| 3,868,211 | 2/1975 | Haye et al. . | |
| 3,883,290 | 5/1975 | Windelbandt . | |
| 4,060,041 | 11/1977 | Sowards . | |
| 4,060,379 | 11/1977 | Haye et al. . | |
| 4,098,200 | 7/1978 | Dauvergne | 110/204 |

*Primary Examiner*—John J. Camby
*Attorney, Agent, or Firm*—Henderson & Sturm

[57] ABSTRACT

A burner throat, secured between a producer and a burner, the burner throat including a superheating means comprising a return gas line drawing hot combusted gases from the burner to the burner throat through an annular chamber surrounding the inlet portion of the burner throat, the burner throat also including an out-of-line fan discharging an air stream vertically in inlet portion of the burner throat to create a suction chamber thereat; the burner is multichambered and includes secondary air inlet means for providing excess oxygen for producer gas combustion in an excess of oxygen, a portion of the burner is enclosed in a tunnel having an open end and a fluid flow, the fluid flow transmits heat from the burner through a first damper in the tunnel, and into a large fan enclosed within a fan room; the fan room has a supplemental heat source and second dampers; the fan has a plenum at its discharge side for receiving a heated discharge fluid flow from the fan to distribute to grain bins; the plenum includes a temperature sensing probe operationally connected to a temperature control means, the temperature control means operates positioning means to simultaneously adjust the first and second dampers and heat generation means to achieve a desired temperature for the heated discharge fluid flow in the plenum.

38 Claims, 9 Drawing Figures

PRODUCER GAS FUELED BURNER SYSTEM AND DRYING APPARATUS

BACKGROUND OF THE INVENTION

The invention relates to the use of organic crop waste products to generate energy; and more specifically, to apparatuses which utilize producer gases, generated from burning organic materials, as fuel to generate heat to be applied to various uses such as grain drying and electrical energy generation.

A primary problem with producers burning organic materials has been the accumulation of a residue within the producer gas flow pipes which eventually substantially blocks the flow passages. Where corn cobs are used to generate producer gases, a tar has collected in the producer gas lines, or burner throats, which carry the combustible gas from the producer to the burner. The tar would not only impede producer gas flow but would also collect upon fan means typically placed in-line in the throat to draw the producer gases into the burner from the producer. The residue, or tar, accumulation has been the result of the condensation, within the burner throat, of distillates which flow with the producer gases out of the producer.

SUMMARY OF THE INVENTION

The present invention overcomes the problems of the prior art, described above, by providing a superheating means at the inlet to the burner throat so that distillates flowing with the producer gases out of the producer are superheated sufficiently above their condensation temperatures to limit condensation within the burner throat to acceptable levels. Additionally, an out-of-line fan means is provided to create suction within the burner throat, by means of a jet airstream, without exposing the fan to any condensate formation within the throat. The superheating means employed is the recirculation of hot combusted gases from the burner. The out-of-line fan has the dual function of providing primary combustion oxygen to the superheated producer/gas distillate flow in the throat so that a superheated combustible mixture is delivered to the burner. The burner is multichambered with an ignition chamber providing for initial combustion, a combustion chamber providing for primary combustion, and a furnace chamber allowing for any final combustion and including the provision of a heated exterior surface to transmit heat to a fluid flow. The burner includes secondary air supplies to permit complete combustion of the producer gases in an excess of oxygen. The heated exterior surface of the furnace is enclosed within a tunnel to heat a fluid flow which is drawn through the tunnel and into a large fan enclosed within a fan room. The fan room includes a supplemental heat source and a plenum receives a heated discharge air flow from the fan to distribute to grain bins. The discharge air flow is monitored, with a temperature control means simultaneously varying the rates of heat generation from the burner and the supplemental heat source, and the positions of fluid control dampers to achieve a desired temperature for the heated discharge fluid flow in the plenum.

It is therefore an object of the present invention to provide a burner system for organically generated producer gases which limits residue accumulation to an acceptable degree.

It is a further object to provide a burner which ensures complete combustion of producer gases in an excess of oxygen.

A still further object is the provision of a fluid flow system which transmits heat from the novel burner system to a plenum for distribution to grain bins.

Another object is the provision of a temperature control mechanism which employs positioners to regulate the temperature of the heated discharge flow of the large fan employed with the present invention.

Still another object is the provision of a means for disposing of organic wastes which simultaneously generates energy which can be usefully applied.

These and other objects, advantages and novel features of the invention will become apparent from the following detailed description of the invention taken in conjunction with the accompanying drawings.

DESCRIPTION OF THE PREFERRED EMBODIMENT

The present invention is a system and apparatus for drying seed corn using organic materials such as corn cobs and other by-products of the seed corn production process as fuel. The system includes a novel producer gas burner system designed to inhibit residue formation which has been a problem in this field.

Figure 1:
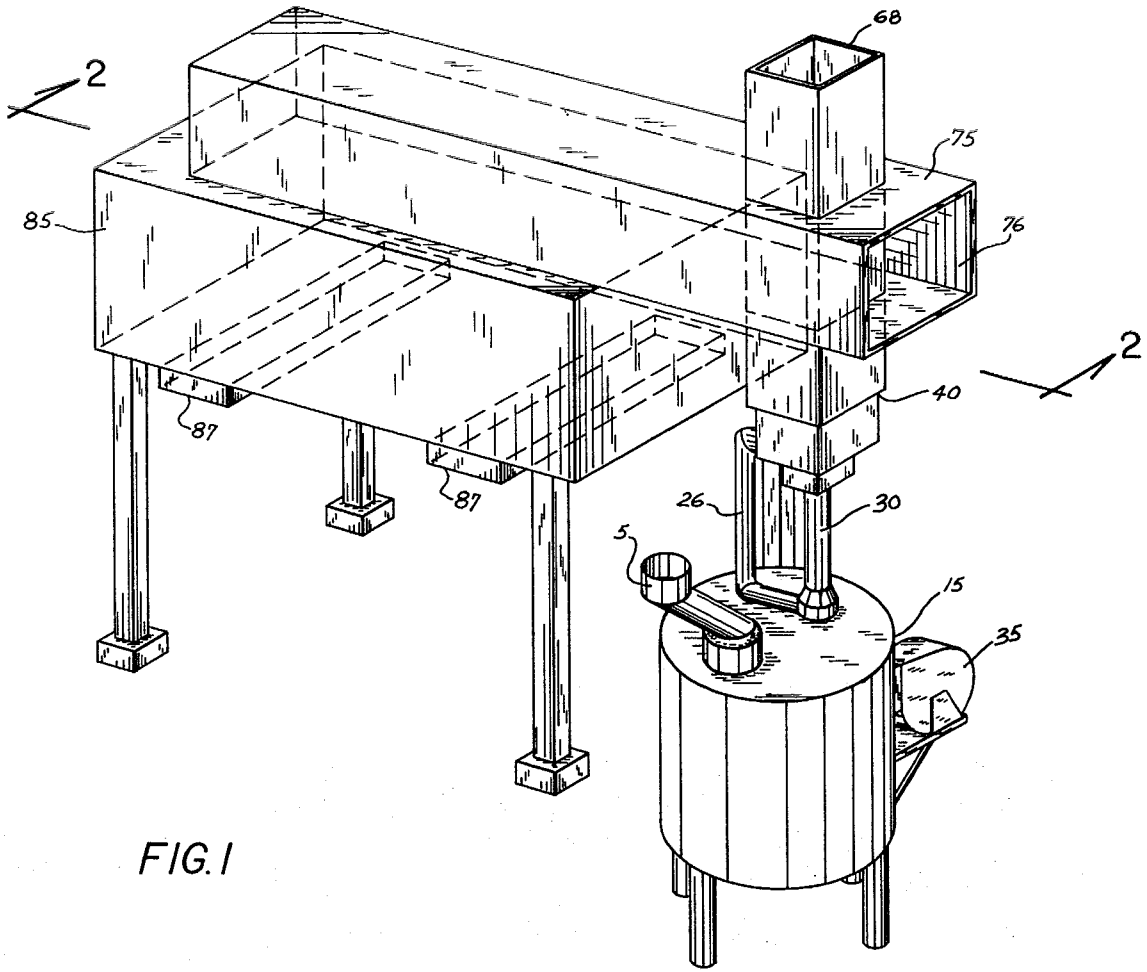
FIG. 1 is a perspective view of the present invention.
Figure 2:
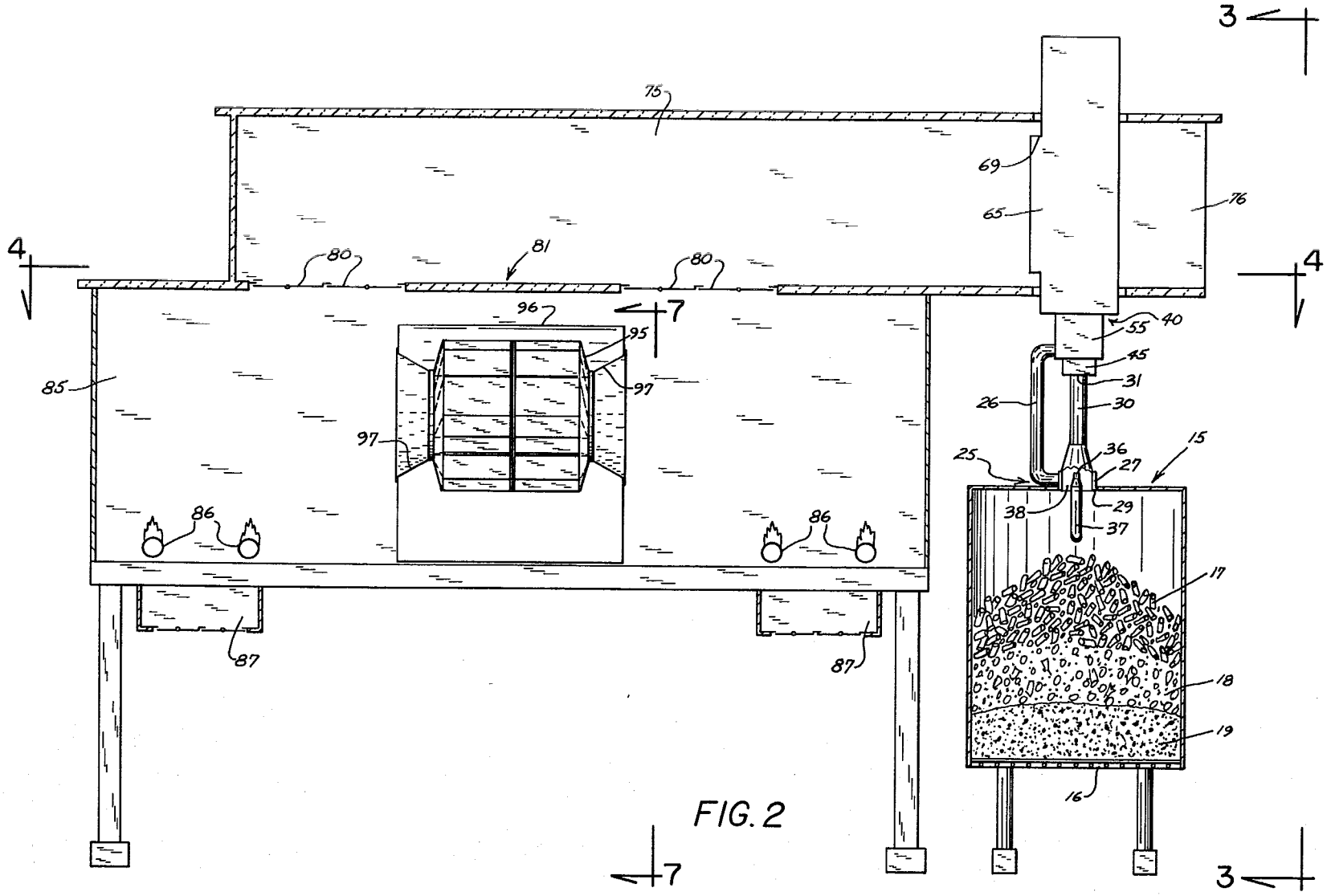
FIG. 2 is a front elevational, cross-sectional view taken along line 2—2 in FIG. 1.
Figure 3:
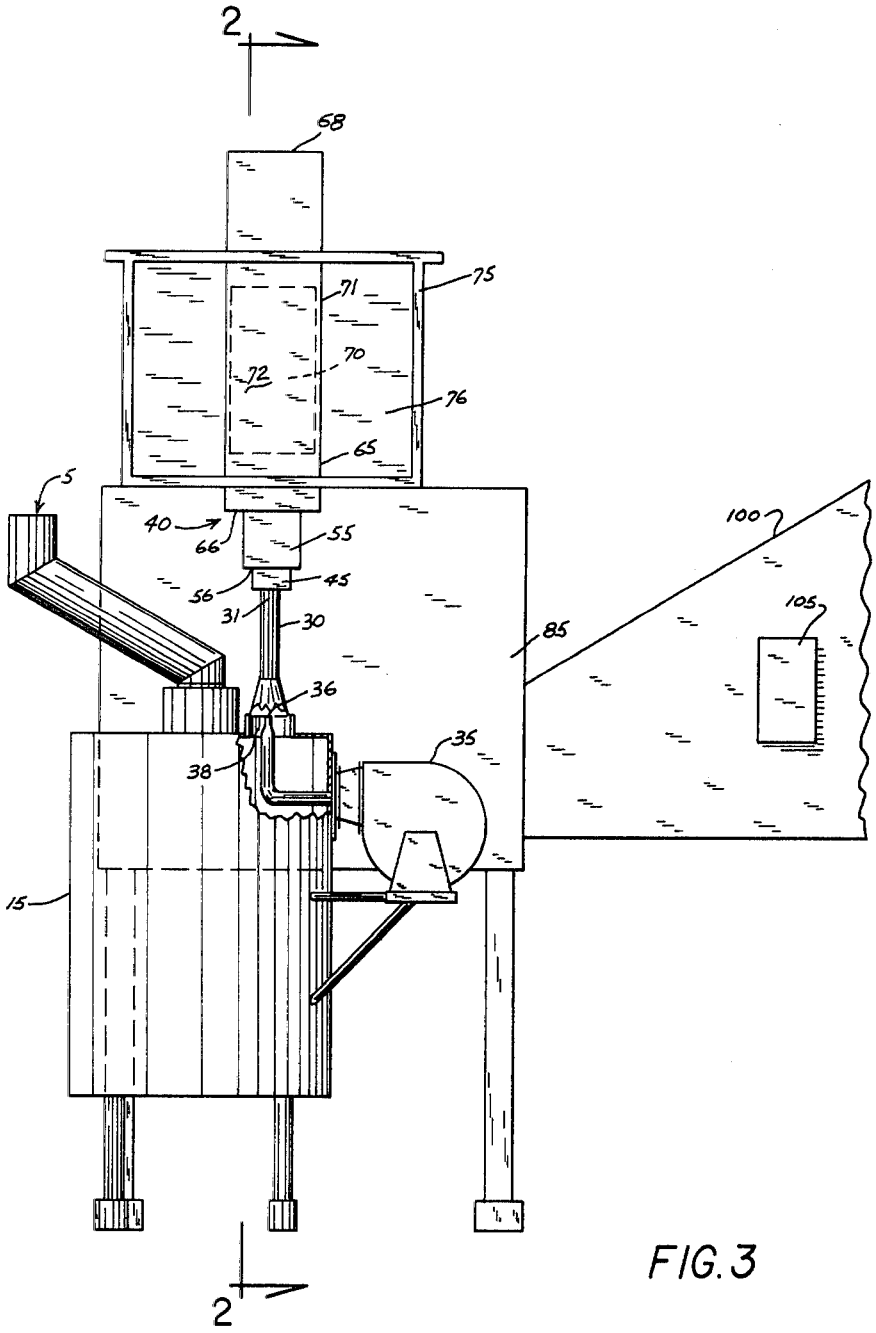
FIG. 3 is an end elevational view taken along line 3—3 in FIG. 2.
Figure 4:
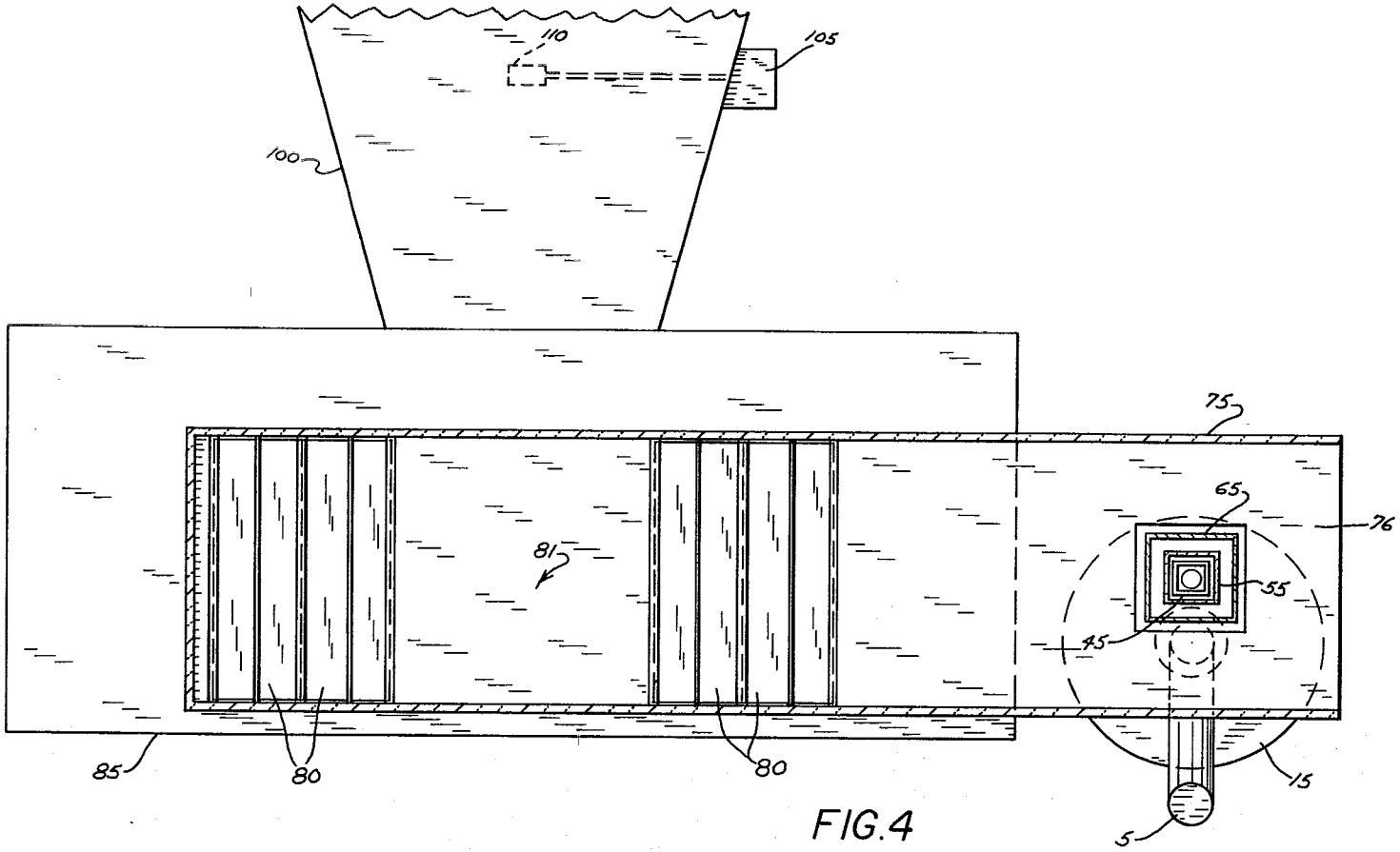
FIG. 4 is a plan view taken along line 4—4 of FIG. 2.

As a brief overview, with reference to FIGS. 1-3, corn cobs are loaded through a feeder 5 into the producer 15 where they are burned to produce a combustible producer gas. The gas is utilized in a novel producer gas burner system 40 which has been designed to inhibit the formation and accumulation of condensates. The producer gas fuels the burner system to generate heat. The heat is transferred to an air flow which is drawn through air tunnel 75 by a fan 95, housed in the fan room 85. The heated air is routed by fan 95 through plenum 100 to bins to dry seed corn, or to some other drying application.

While the instant application of the heat generated by the present burner system is to dry seed corn; it should be understood that the described drying application is merely representative and that the heat generated by the burner system could obviously be applied to various other uses such as to power an electric generator, for example.

In the description which follows, the producer 15 will be described only in limited detail inasmuch as gas producers are well-known in the art. It is, moreover, intended to be understood that producers burning organic materials other than corn cobs to yield producer gases could be utilized to accomplish the purposes of this invention, and thus, that the invention is not intended to be limited to the producer briefly described herein. In particular, refuse grains, fungicide treated corn, and husk materials from shelling would be suitable organic fuels for use with the present invention.

Now, more particularly, with reference to FIG. 1—3, once the cobs have been loaded through the feeder 5 into producer 15, and the invention is operating normally, the fuel bed within the producer 15, may be considered to consist of three zones: The uppermost zone is the distillation zone 17, the intermediate zone is the reduction zone 18, and the lowermost zone is the oxidation zone 19. The cobs travel down through these zones being successively reduced in each zone so that they leave the bottom 16 of producer 15 as ashes. A waste disposal means, typically of a conveyor type, is normally provided under the producer to dispose of the ashes. The oxidation zone 19 is comprised of hot coals and includes an air flow introduced through the bottom 16. In the reduction zone 18 the cobs are in a charcoal form, and in this zone 18 the producer gases, primarily carbon monoxide and hydrogen, are formed. These producer gases flow upward through the distillation zone 17 due to a suction in the burner throat 30 (later described). In flowing through zone 17, the hot gases rise through the cobs, carrying along amounts of water and hydrocarbons which are distilled from the cobs. These distillates flow with the producer gases to comprise a producer gas/distillate flow to burner 40 through burner throat 30. Note that the producer is under a negative pressure so that harmful, or undesireable gases can't leak into the atmosphere.

In the past, the problem has been that a substantial portion of the distillates have condensed out of the gas mixture while traveling through the burner throat 30, resulting in the formation of gummy residues, or tar, in the throat 30. In time, the residues would accumulate to the point where the flow through the throat 30 was substantially restricted. In addition, it has been customary in the prior art structures to employ an in-line fan means in the burner throat to draw the producer gas out of the producer 15. The residues would accumulate on the fan rendering it effectively inoperable unless regularly cleaned.

The present invention discloses a structure which was invented to eliminate this residue problem.

The structure comprises a burner system which includes a novel burner throat design 30 which mixes a primary air supply with the combustible gas mixture to provide for combustion in the three chambered burner 40. The throat structure 30 in addition to mixing primary combustion air, later described in detail, has been specifically designed to inhibit condensate formation, and thereby, solve the residue problem described above.

This burner throat structure comprises the combination of an out-of-line fan 35 with a super heating means 25.

Figure 5:
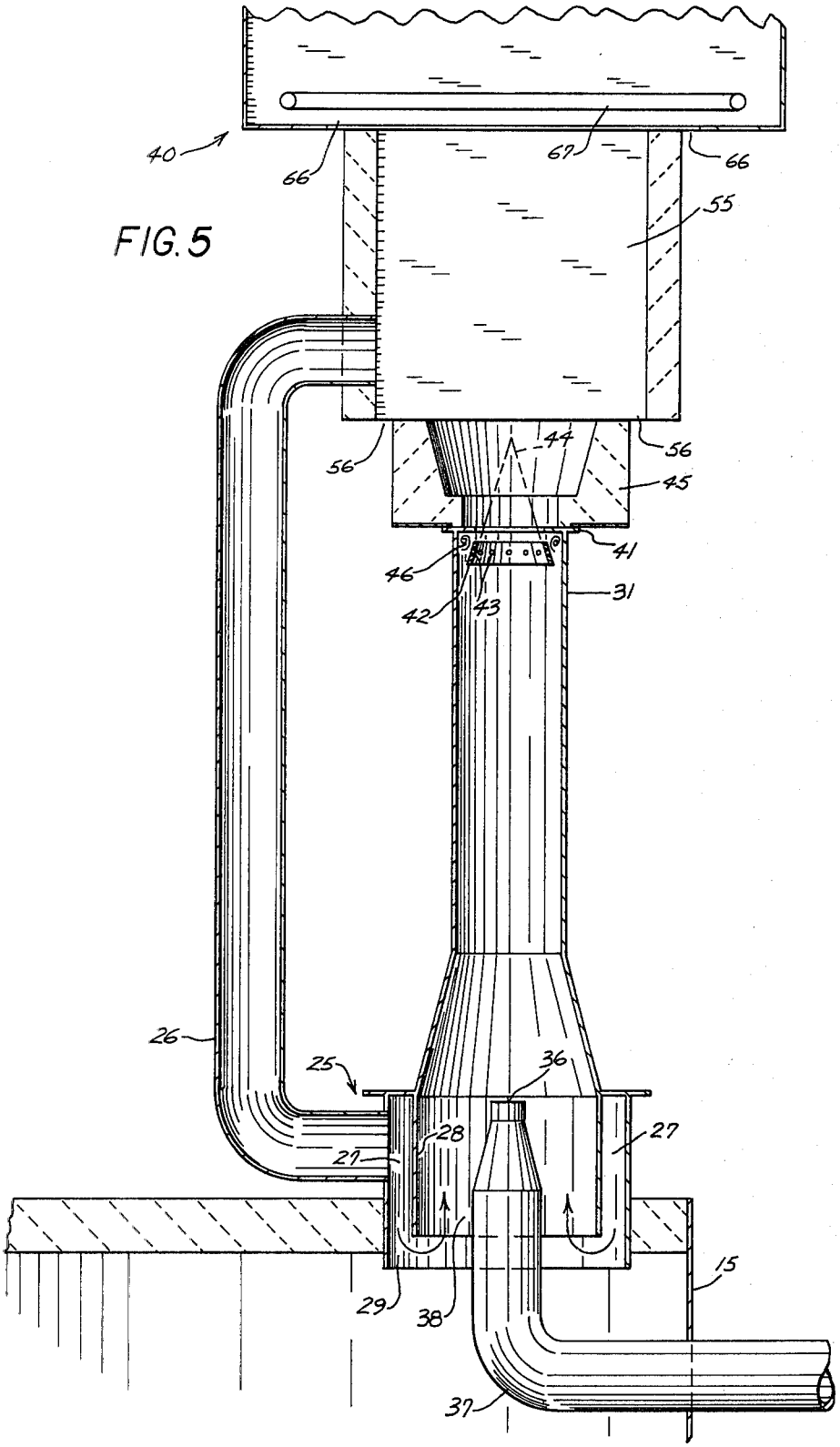
FIG. 5 is an elevational, cross-sectional view of the burner throat of the present invention secured between the producer and the burner.

With particular reference to FIGS. 3 and 5, the out-of-line fan 35 draws in outside air at ambient temperature through an ambient air inlet (not shown) and expels it in a high velocity air stream through jet 36 disposed at the discharge end of nozzle 37. The air nozzle 37 is directed vertically upward in the inlet portion of burner throat 30, and creates a suction force in suction chamber 38 of throat 30 which is directly proportional to the velocity of the air stream. That is, the greater the velocity of the air stream, the lower the pressure in chamber 38, and thus, the greater the suction force drawing in the producer gas/distillate flow. The fan 35 includes an inlet butterfly valve (not shown) which can be adjusted to regulate the air intake and therefore, the velocity of the air jet. The butterfly valve, thus, regulates the suction force in the burner throat 30. (This butterfly valve is tied in with an overall temperature control mechanism which will be described later.) Inasmuch as the fan 35 is taken outside of the producer gas/distillate flow, it is kept free of any residues which condense within the throat 30.

The air stream, in addition to motivating the gas flow, serves the dual function of providing the primary air supply for combustion.

In fact the air stream introduced jet 36 comprises a primary combustion oxygen airstream inasmuch as it is designed to supply sufficient oxygen to permit complete combustion of the gas generated by the producer. To appreciate this feature, recall that the velocity of the jet stream determines the amount of suction force in suction chamber 38. The suction force in chamber 38, in turn, determines the amount of air drawn in through the bottom 16 of the producer 15 for combustion of the cobs. Note, that cob loader 5 is air sealed. Therefore given the suction force in suction chamber 38, the bottom 16 provides the air inlet for the upward fluid flow through the producer. The velocity of the jet air stream, therefore, determines the amount of oxygen available for cob combustion, and hence, the rate of production of producer gases. Given this direct relationship, one skilled in the art can determine the amount of oxygen supplied through jet 36, or the rate of air mass flow, which is necessary to permit complete combustion of gas generated in a producer of given configuration. It can, accordingly, be appreciated that the present invention is designed to provide sufficient oxygen via jet 36 to permit complete combustion of the producer gases generated at any given jet stream velocity. Observe that the mixture of the primary combustion oxygen air stream with the producer gas/distillate flow in suction chamber 38 produces a combustible mixture which will burn at combustion temperature. It is also noted that the butterfly valve of the out-of-line fan 35, by determining the air stream velocity and rate of producer gas generation, thereby comprises a heat generation adjustment means for the burner 40.

Figures 8, 9:
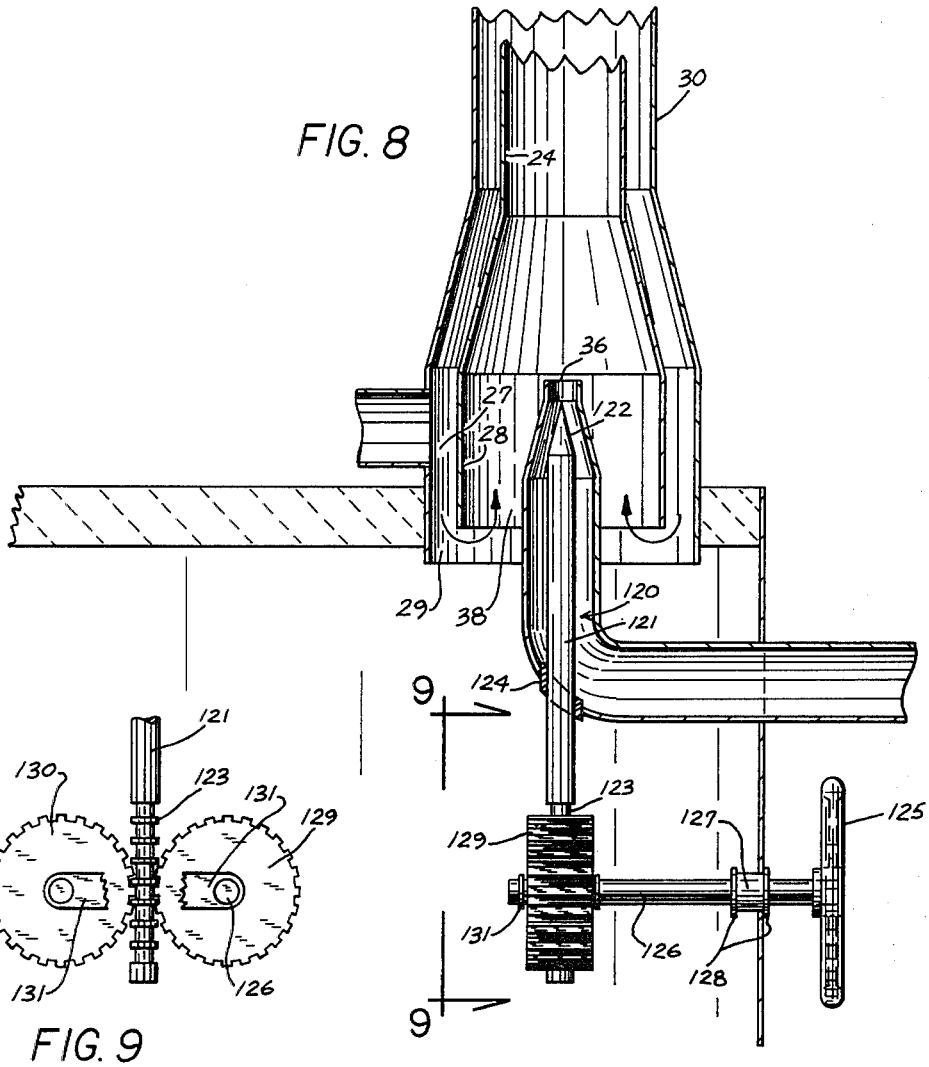
FIG. 8 is an elevational cross-sectional view of an alternate embodiment of the out-of-line fan showing a needle valve adjustment means for the airstream jet.
FIG. 9 is an elevational side view taken along line 9—9 in FIG. 8 showing the adjustment mechanism of the needle valve.

FIG. 8 shows an alternate embodiment of the out-of-line fan which includes a means for adjusting jet 36. A needle valve 120 which is adjustable vertically to vary the flow from jet 36. While various adjustment mechanisms could be utilized, here a notched end 123 of shaft 126 is sandwiched between notched wheels 130 and 129 connected by link 131. Idler wheel 130 is rotationally secured to a shaft (not shown) which is rigidly secured to producer 15; while driving wheel 129 is rigidly secured to a shaft 126 which is rotationally secured to producer 15 by means of spacer discs 128 and bearing seal 127. The hand wheel 125 can, thus, be operated to move the shaft 121 vertically with respect to bearing seal 124, and adjust the position of pointed end 126 relative to jet 36. The valve 120, therefore, is adjustable to vary the velocity of the air stream, and the rate of our mass flow expelled from jet 36.

In combination with the out-of-line fan 35, a superheating means 25 is employed to inhibit condensation. The superheater 25 superheats the producer gas/distillate flow, or combustible mixture, in the suction chamber 38 to a superheated temperature so that the distillates are held above their condensation temperature. By maintaining the distillates above their condensation temperature while they travel through the producer gas line, they remain gaseous and do not convert to the liquid residue form.

In that the distillates were distilled from the cobs at the temperature of the gases in the producer, or the producer temperature, they will begin to condense at temperatures at and below that producer temperature. Therefore, to prevent condensation within the throat 30, the distillates must be maintained at a superheated temperature in excess of the producer temperature while flowing to the burner 40.

While various means could be utilized to superheat the producer gas/distillate flow, in the preferred embodiment, hot combusted gases are recirculated from the burner and introduced into suction chamber 38. FIGS. 2 and 5 show the return gas line 26 rerouting hot combusted gases from the combustion chamber 55 of the burner 40 (later described) to an annular collar 27 which encircles suction chamber 38. The hot gas travels down the collar 27 and out through open end 29 where it mixes with and superheats the producer gas/distillate flow draw into the suction chamber 38.

The applicant has found that the hot combusted gas from burner 40 is generally at a temperature significantly hotter than the producer temperature. Superheating by means of these gases has, thus, been found to eliminate, or at least, substantially inhibit condensation.

The suction necessary to draw the hot gases down return line 26 is provided by the fluid communication between annular collar 27 and suction chamber 38 via open end 29. The suction force of chamber 38 draws the hot gases down line 26 to mix with the upward flowing producer gas/distillate flow. Inasmuch as the producer gas/distillate flow is virtually simultaneously being mixed with the primary combustion oxygen air stream through jet 36, and superheated by mixture with the hot combusted gases introduced through the annular collar 27, a superheated combustible mixture is produced in the suction chamber to flow upward through the burner throat 30 and into burner 40.

It is observed that even though the air introduced by fan 35 will become heated somewhat in passing through the hot curved nozzle 37 before arriving at jet 35, the air stream will cool the producer gas/distillate flow somewhat, and thereby, cause some condensation of the distillates. Any condensation, however, will be kept at an acceptable level by the superheating effect of the hot return gas described above.

Figure 6:
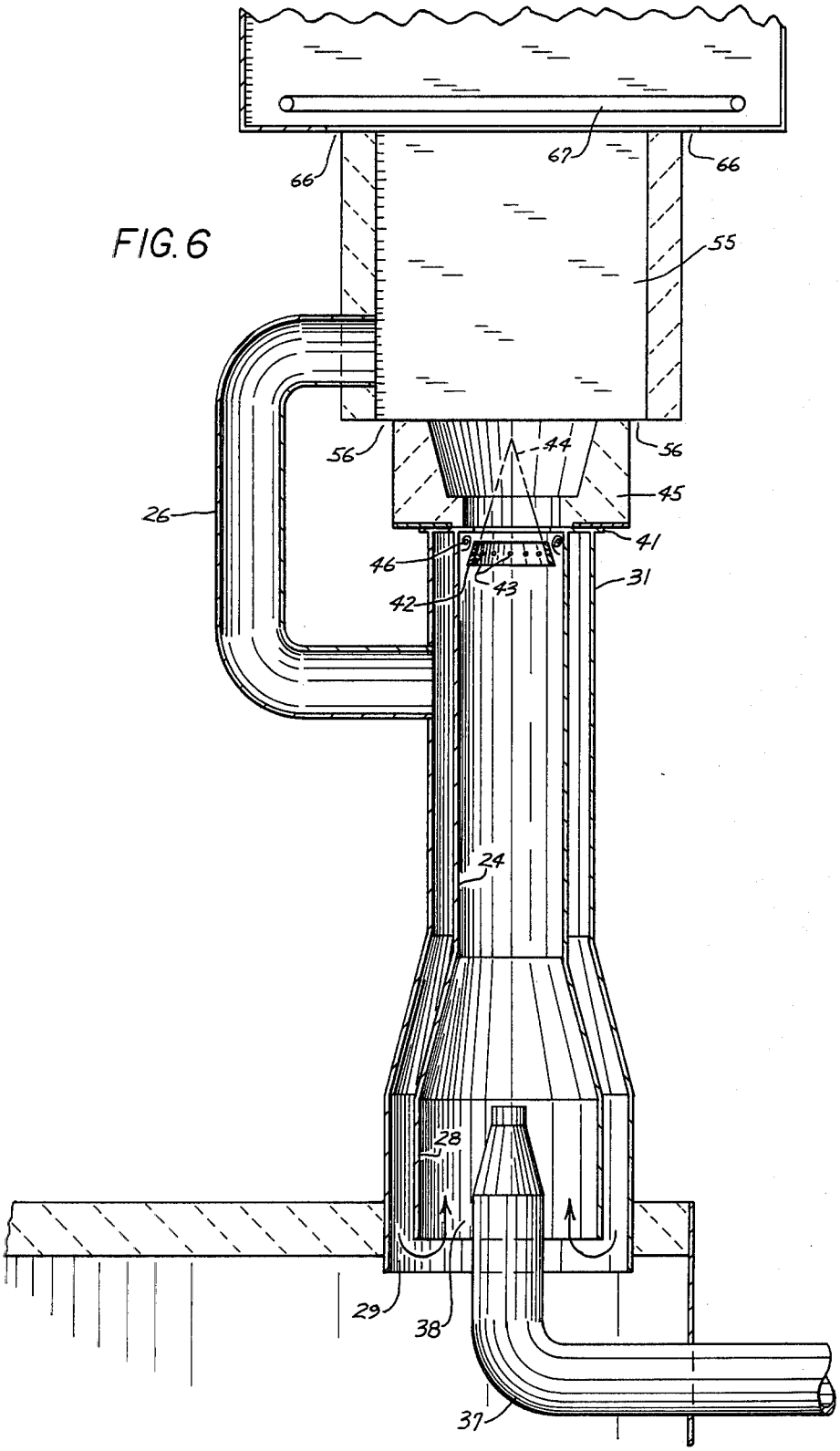
FIG. 6 is an elevational cross-sectional view of an alternate embodiment of a hot jacket portion of the burner throat of the present invention.

It is also noted that the vertical orientation of throat 30 causes any liquid condensate forming on the inside walls to either drip back down into the producer 15, or to be drawn upward into burner 40 inasmuch as liquids can not remain at reast on vertical surfaces. Liquid condensate particles not forming on the walls of throat 30 will remain in the fluid flow and travel into burner 40. With reference to FIG. 5 it can furthermore be appreciated that annular chamber 27 comprises a hot jacket encircling suction chamber 38 such that the inside surface 28 of suction chamber 38 runs quite hot. The heat of chamber wall 28 prevents condensate from forming thereon, and therefore, the wall 28 runs clean. Moreover, where condensate conditions are more severe, the hot jacket can be extended upwards to encircle the entire length of throat 30, or, at least, an intermediate portion thereof. See FIG. 6. Here, hot return gas line 26 is relocated upwardly, so that the hot combusted gases must flow down the entire length of throat 30 before being drawn into suction chamber 38. In this alternate embodiment, condensate is unable to form on the interior walls 24 of throat 30 due to their heated state, and consequently, any liquid condensate particles would remain in the fluid flow and travel into burner 40. In either embodiment, therefore, the hot combusted gases both superheat the producer gas/distillate flow and provide for a hot jacket to inhibit condensate formation.

Thus, the intake structure of the present invention reduces the residue problem by superheating the producer gas/distillate flow while providing a suction force in the throat 30 without exposing the fan means to any condensate which may form. This later feature minimizes the maintenance effort required to keep the fan operational.

With the burner throat 30, thus, designed to permit substantially unimpaired flow, the superheated combustible mixture is introduced into the burner 40 through the outlet portion 31 of throat 30.

The burner 40 is a multichambered burner comprised of three chambers, or combustion zones. Briefly: The first is the ignition chamber 45 which initially provides combustion temperature for the superheated combustible mixture provided by burner throat 30. The second is the combustion chamber 55 wherein the principal combustion ensues. The third combustion zone comprises the furnace chamber where complete and final combustion of any remaining combustible gas ensues in an excess of oxygen.

Now, more specifically, just below, the entrance to ignition chamber 45 a flame retention ring 41 is secured within the outlet portion 31 of throat 30. (See FIG. 5) The ring 41 includes a flame retention, or igniting, means of a type which is well known in the art. The flame retention means comprises an angled flange 42 having apertures 43 spaced intermittently thereabout. In operation, the flange 42 constricts the incoming superheated combustible mixture so that its velocity is increased and a cone shaped flame boundary 44 is created. The flame doesn't penetrate cone 44 because the velocity of the flame front is less than the velocity of the incoming superheated combustible mixture within the cone 44. The apertures 43 encircling flange 42 leak the combustible mixture through the flange where it ignites to create low velocity flame eddys 46. These eddys 46 swirl about just below the inlet portion of ignition chamber 45 and ignite the incoming superheated combustible mixture around the base of cone 44.

As has been explained above, combustion of the producer gases in ignition chamber 45 is permitted by the primary combustion oxygen supplied by the jet air stream of the out-of-line fan 35. The burner 40 of the instant structure, however, in order to ensure complete combustion, provides for secondary air supplies which ensure that oxygen in excess of that required for complete combustion is available. The first flow of excess combustion oxygen is provided through second air inlet means 56 of the combustion chamber 55. Combustion chamber 55 is the principal combustion chamber, burning the major share of the unburned portion of the combustible mixture flowing from the ignition chamber.

After combustion in combustion chamber 55, the combustible mixture comprises a primary hot combusted gas flow flowing upward into the furnace chamber 65. Recall that return gas line 26 draws a portion of the hot combusted gas flow from combustion chamber 55 for recirculation as described above. While complete combustion is normally achieved in combustion chamber 55, final, and complete, combustion of the producer gases may occur in the furnace chamber 65. Third air inlet means 66, positioned at the base of furnace 65, provides for the mixing of a second flow of excess combustion oxygen to complete the combustion of any remaining producer gases. Furnace 65 includes a gas ring burner 67 which serves both as a pilot and a smoke control means at cold start up as will later described more fully. Furnace 65 comprises a steel chamber having an open upper end 68 which functions as a stack, or chimney. The primary hot combusted gas flow flows upward through the furnace 65, being discharged through stack 68 as a stack discharge flow. The upward flow of the hot combusted gases through the interior region 70 heats its exterior wall 71 so that the exterior surface 72 of furnace chamber 65 becomes quite hot. Furnace 65 is positioned centrally at the open end 76 of an air tunnel 75 as shown in FIGS. 2 and 3. The tunnel 75 encloses a portion of the heated exterior surface 72. During normal operation, the tunnel 75 includes a fluid flow flowing proximate to enclosed heated surface 72 so that heat is transferred to the fluid flow, the fluid flow comprising a first heated fluid flow.

As is best seen in FIG. 2, air tunnel 75 is in fluid communication with fan room 85 by means of first dampers 80 which are located on a common wall 81. Fan room 85 houses large fan 95, and when the fan 95 is operating, and the dampers 80 are open, a fluid flow is drawn down the tunnel 75 and into fan room 85. This fluid flow will be drawn in through the open end 76 of the tunnel 75, and circulate about the enclosed heated surface 72 of the furnace 65 where it will absorb heat. The furnace has an opening 69 and the movement of the fluid flow past the furnace 65 will create a low pressure area at opening 69, drawing a portion of the primary hot combusted gas flow out of the furnace through side opening 69, this furnace opening discharge flow further heating first heated fluid flow. This first heated fluid flow is then drawn into the fan 95 via first dampers 80.

Figure 7:
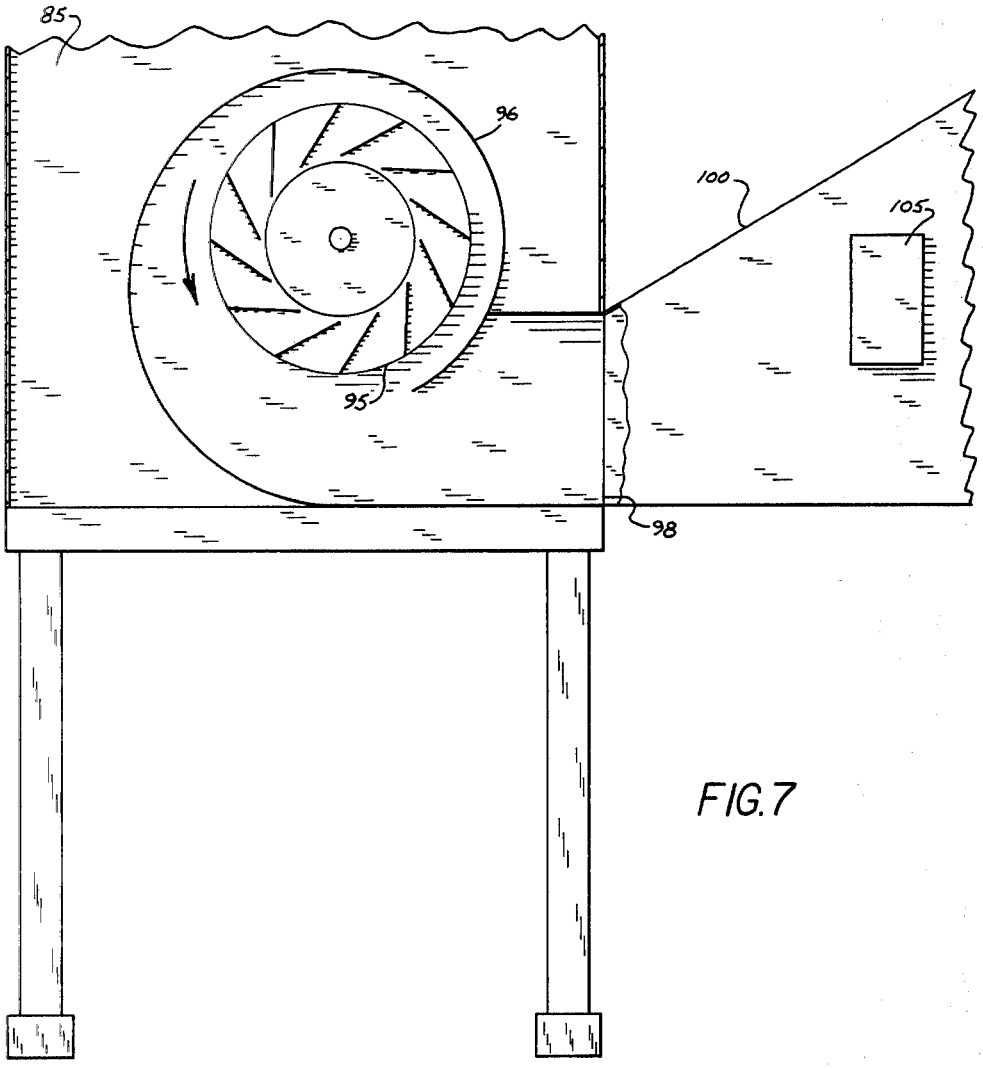
FIG. 7 is a cross-sectional, elevational side view taken along line 7—7 of FIG. 2.

Large fan 95 is enclosed by an eccentric housing 96 which includes inlet openings 97. The housing 96 has a discharge side 98 with a plenum 100 secured thereto. See FIG. 7. The first heated fluid flow is drawn into large centrifugal fan 95 through diametrically opposed inlet openings 97, and expelled from the housing 96, via discharge side 98, into plenum 100 as a heated discharge fluid flow. The heated discharge fluid flow is routed through plenum 100 to bins (not shown) to dry seed corn or to some other drying or heating application.

Fan room 85 also includes auxiliary burners 86 and second dampers 87. Second dampers 87 can be opened to permit the flow of outside ambient air into fan room 85. Auxiliary burners 86 are employed as a supplemental heat source and are utilized when the heat obtained from the furnace 65 is insufficient in a manner later described. While various conventional burners would be suitable, in the preferred embodiment, gas burners are utilized as auxiliary burners 86.

A temperature control mechanism 105, including a temperature sensing probe 110 disposed in plenum 100, is positioned subsequent the discharge side of fan 95 to regulate the dampers, gas burners and the furnace to achieve a desired temperature in the heated discharge fluid flow. (Note that locating the temperature probe in close proximity to the bins is advisable to ensure a stable, reliable reading.) The control mechanism links the butterfly valve of the out-of-line fan, the first dampers, the gas burners, and the second dampers by several interconnected positioners which operate simultaneously.

Inasmuch as there are various control systems which could be designed to operate the temperature control mechanism hereinafter described, the control system will not be described in detail. Various means well known to one of ordinary skill in the control industry are available to function as hereinafter specified. The term positioners is, thus, intended to represent any suitable system and could include the use of hydraulic cylinders, air cylinders, or electric motors, for example.

The temperature control system is capable of operating in four modes: a start-up mode, a furnace only mode, a gas burners only mode, and a combination mode. An operator is available to monitor the system, and will make all major changes in the system such as switching the system from one mode to another.

In the start-up mode, with the first dampers closed, cobs are burned in the producer to yield producer gases which flow up into the furnace 65 where they are ignited by the gas ring burner pilot 67. The ring burner also serves as a smoke control means until the furnace achieves operating temperature by burning the smoke, or oxidizing the otherwise visible carbon particles. With the furnace and the other two burner chambers described above providing for complete combustion of the producer gases, operating temperature is achieved, and the pilot burners are no longer required for smoke control or to sustain the flame, and they are turned off.

With the burner system at operating temperature the operator selects the system into the furnace only mode. The fan will be either manually turned on from a cold start, or will have to be selected out of the gas burners only mode, later described. In either case, the temperature sensing probe 110 will register the temperature of the heated discharge fluid flow in the plenum 100, and if the discharge flow is below the desired temperature, the control system 105 will activate the first damper positioners to begin to open the dampers 80. All of the apparatuses operated by the positioners have open, closed and various intermediate positions. As the first dampers 80 are opened, the rate of flow of the first heated fluid flow down tunnel 75 is increased. And as the first dampers are opened, the positioners will simultaneously open the butterfly valve of the out-of-line fan increasing the suction in the throat 30, and thus, the rate of producer gas and heat generation in the furnace 65. This increased heat is carried off by the increased fluid flow through the air tunnel 75 caused by the simultaneously opened first dampers 80, described above. Therefore, by operating the dampers and butterfly valve simultaneously the temperature of the heated discharged fluid flow is quickly increased. It is observed that while the positioners are opening the furnace dampers and the butterfly valve, they are simultaneously opening the throttle valves of gas burners 86, and closing the second dampers 87; although dampers 87 are never fully closed. In the furnace only mode, however, the gas burner pilots are not activated, and the gas supply line valve is closed. Consequently, the gas burners are supplying no supplemental heat in the furnace only mode even though their throttle valves have been opened.

If the desired temperature is not achieved with the first dampers and the out-of-line fan butterfly valve in their fully open positions, the control system may be selected by the operator into the combination mode. (Note that various instruments would be available to the operator including a plenum temperature gage from which he can determine what actions are necessary to achieve the desired temperature.) In selecting the system into the combination mode the operator will activate the gas burner pilots. With the pilots activated, the on/off supply valve can be manually opened to supply gas to the burners 86. The throttle valve at burner 86 is then operated by a positioner to regulate the flow of gas to the burners 86, and consequently, the rate of supplemental heat generation. Since, at this point, the first dampers and butterfly valve are fully open, and the gas burners are, likewise, at full force, with the second dampers nearly closed, the desired discharge air flow temperature will be achieved within the design limitations. If the desired temperature is exceeded, the control mechanism will activate the positioners to start to close the first dampers, butterfly valve, and gas burner throttling valves to reduce heat generation; and, simultaneously, the mechanism will open the second dampers to permit cooler outside air to merge with and cool the flow through the fan. The gas burners together with the second dampers, thus, supply a variable temperature air flow to fan 95.

The control mechanism will remain in this combination mode, automatically regulating the system to stay at the desired temperature. In order to switch back to the furnace only mode the gas burner on/off supply valve would be manually closed, terminating the generation of supplemental heat.

The system also includes a gas burners only mode during which the fan draws heat only from the gas burners 86. In this mode the second dampers remain in the fully open position, and the first dampers in the fully closed position.

In closing, the present invention, as can now be understood, comprises a structure which can utilize the byproducts of grain production to generate heat and dry the grain products. The invention, moreover, has great flexibility in application, and can be adjusted to accomodate virtually any conceivable number of grain bins. Depending on the drying demand, and the availability of grain production byproducts such as corn cobs, the structure can generate the required heat solely by means of waste products combustion, or can be used in combination with conventional burners when necessary.

Having, thus, disclosed the present invention it can be appreciated that the invention will indeed function as described. It is intended to be understood, however, that various changes could be made to the disclosed structure which would be only obvious modifications thereof, and therefore, within the teachings set forth herein. Accordingly, within the scope of the appended claims, the invention can be practiced otherwise than as specifically described.

I claim:

1. In combination with a gas producer, said gas producer being suitable for generating a combustible producer gas from the combustion of organic materials, said combustible producer gas comprising a producer gas flow traveling through a portion of said organic materials, said producer gas flow including distillates which distill out of said organic materials and comprising a producer gas/distillate flow, said distillates have a condensation temperature, comprising:

a burner means for combustion of said combustible producer gases externally disposed with respect to said gas producer; and a burner throat means for providing fluid communication with and disposed between said producer and said burner means, said burner throat means carrying said producer gas/distillate flow from said producer to said burner means, said burner throat means including a superheating means for superheating said producer gas/distillate flow to a superheated temperature, said superheated temperature being above said condensation temperature, said superheated producer gas/distillate flow having a temperature above said condensation temperature while flowing through said burner throat means.

2. The apparatus of claim 1 further comprising a fan means for moving a fluid flow through said burner throat means.

3. The apparatus of claim 2 wherein said superheating means comprises a return gas line, said return gas line providing for fluid communication between said burner means and said burner throat means, a hot combusted gas flow moving from said burner means through said return gas line and into said burner throat means, wherein said hot combusted gas flow superheates said producer gas/distillate flow.

4. The apparatus of claim 3 wherein said burner throat means has an inlet portion, and said fan means is an out-of-line fan, said out-of-line fan including a nozzle and a jet, said nozzle having a discharge end, said jet being disposed at said discharge end and being proximate said inlet portion of said burner throat means, said out-of-line fan having an ambient air inlet and discharging an air stream through said jet to move said fluid flow through said burner throat means.

5. The apparatus of claim 4 wherein said air stream from said jet creates a low pressure region in said inlet portion of said burner throat means, said inlet portion comprising a suction chamber, said suction chamber being surrounded by an annular collar, said annular collar having an open lower end, said annular collar providing for fluid communication between said return gas line and said suction chamber.

6. The apparatus of claim 5 wherein said burner throat means is vertically oriented, said annular collar having said hot combusted gas flow passing therethrough and comprising a hot jacket surrounding said suction chamber, said suction chamber having an inside surface, said hot jacket transmitting heat to said inside surface whereby condensation of said distillates upon said inside surface is inhibited.

7. The apparatus of claim 6 wherein said out-of-line fan discharges said air stream vertically within said vertically oriented burner throat means, said jet being positioned above said open end of said annular collar, and wherein said air stream comprises a primary combustion oxygen air stream which mixes with said superheated producer gas/distillate flow to comprise a superheated combustible mixture.

8. The apparatus of claim 7 wherein said burner throat means has an outlet portion, and wherein said outlet portion is rigidly secured to said burner means, and said inlet portion is rigidly secured to said gas producer, said burner throat means further including a flame retention ring disposed proximate said outlet portion, said flame retention ring constricting said superheated combustible mixture as said superheated combustible mixture is discharged from said outlet portion.

9. The apparatus of claim 8 wherein said burner means comprises a multichambered burner which includes an ignition chamber, a combustion chamber, and a furnace chamber; said ignition chamber having an inlet portion proximate said outlet portion of said burner throat means, an incoming superheated combustible mixture being discharged from said burner throat into said ignition chamber, a portion of said incoming superheated combustible mixture being ignited by said igniting means, and said flame retention ring constricting said incoming superheated combustible mixture to produce a conical flame barrier, a portion of said incoming superheated combustible mixture being burned within said ignition chamber to comprise an amount of hot combusted gas; said combustion chamber being positioned operationally subsequent said ignition chamber, an unburned portion of said superheated combustible mixture flowing from said ignition chamber to said combustion chamber, said hot combusted gases also flowing from said ignition chamber to said combustion chamber, said combustion chamber including a second air inlet means for providing a first flow of excess combustion oxygen, a large portion of said unburned portion of said superheated combustible gas being burned in said combustion chamber to comprise a primary hot combusted gas flow, a portion of said hot combusted gas being drawn from said combustion chamber through said return gas line and comprising said hot combusted gas flow; said furnace chamber being positioned operationally subsequent said combustion chamber, said primary hot combusted gas flow flowing from said combustion chamber to said furnace chamber, said furnace chamber including a third air inlet means for providing a second flow of excess combustion oxygen, said furnace chamber having an open upper end, said open upper end comprising a stack, said primary hot combusted gas flow being discharged through said stack and comprising a stack discharge flow.

10. The apparatus of claim 9 further comprising an air tunnel, said air tunnel enclosing a portion of said furnace chamber, said furnace chamber having an interior region and an exterior wall, said exterior wall enclosing said interior region and having an exterior surface, said primary hot combusted gas flow flowing through said interior region and transmitting heat to said exterior wall wherein said exterior surface of said enclosed portion becomes an enclosed heated surface, said air tunnel having an open end and being in fluid communication with a large fan, said air tunnel having a fluid flow from said open end to said large fan, a portion of said fluid flow flowing proximate to said enclosed heated surface and absorbing heat therefrom wherein said fluid flow becomes a first heated fluid flow, said first heated fluid flow being drawn into said large fan.

11. The apparatus of claim 10 wherein said large fan is enclosed within a fan room, and said fan room is in fluid communication with said air tunnel by means of a first damper, and wherein said enclosed heated surface of said furnace has an opening facing away from said open end, said fluid flow creating a low pressure area adjacent said opening whereby a portion of said primary hot combusted gas flow is drawn out of said interior region of said furnace through said opening to comprise a furnace opening discharge flow, said furnace opening discharge flow mixing with said first heated fluid flow and thereby increasing the temperature of said first heated fluid flow.

12. The apparatus of claim 11 said fan room includes a gas burner and a second damper, said second damper permitting fluid communication between said fan room and ambient air outside of said fan room, said gas burner comprising a supplemental heat source and being operable with said second damper to provide a variable temperature air flow to said large fan.

13. The apparatus of claim 12 wherein said large fan is enclosed by an eccentric housing, said eccentric housing having an inlet opening and a discharge side, a plenum chamber being proximate said discharge side and in fluid communication with said eccentric housing, said large fan drawing in said first heated fluid flow and said variable temperature air flow through said inlet opening, and discharging a heated discharge fluid flow through said discharge side and into said plenum, a temperature sensing probe being disposed in said plenum chamber, said probe being operationally connected to a means for temperature control wherein said probe indicates to said temperature control means whether said heated discharge fluid flow in said plenum has a temperature above a desired temperature or below said desired temperature, said temperature control means being operably connected to plurality of positioning means for adjusting a plurality of adjustable apparatus, said adjustable apparatus including said out-of-line fan, said first damper, said gas burner, and said second damper, said temperature control means operating said positioner means to achieve said desired temperature in said heated discharge fluid flow in said plenum.

14. The apparatus of claim 13 wherein said burner means has a rate of heat generation and said out-of-line fan comprises a heat generation adjustment means for varying said rate of heat generation, said heat generation adjustment means being variable between an open and a closed position and having a plurality of intermediate positions intermediate said closed and open positions, said first and said second dampers also having open, closed and intermediate positions, respectively, said first and second dampers providing for increasing fluid communication as said first and second dampers are moved from said closed to said open positions, respectively, said gas burner including a throttle valve, said throttle valve having open, closed and intermediate positions, said gas burner having a rate of supplemental heat generation, said rate of supplemental heat generation increasing as said throttle valve is moved from said closed position to said open position; said positioning means being operably connected to said apparatuses to vary said heat generation adjustment means, said first and said second damper, and said throttle valve between said open and closed positions, respectively; said positioning means being operable to simultaneously open said heat generation adjustment means, said first damper, and said throttle valve while simultaneously closing said second damper, said second damper being in said closed position when said heat generation adjustment means, said first damper and said throttle valve are in said open positions, respectively.

15. The apparatus of claim 14 wherein when said probe indicates to said temperature control means that said heated discharge fluid flow has a temperature below said desired temperature, said temperature control means will operate said positioning means to simultaneously move said heat generation adjustment means, said first damper, and said throttle valve towards said open positions while said positioning means simultaneously move said second damper towards said closed position.

16. The apparatus of claim 15 wherein when said probe registers a heated discharge fluid flow temperature above said desired temperature, said temperature control means will simultaneously close said heat generation adjustment means, said first damper and said throttle valve while said positioners simultaneously open said second damper.

17. The apparatus of claim 16 wherein said heat generation adjustment means comprises a butterfly valve included within said out-of-line fan, said butterfly valve having a open, a closed and a plurality of intermediate positions, and wherein said air stream discharged from said jet has a discharge velocity, said discharge velocity increasing as said butterfly valve is moved from said closed to said open position, said rate of heat generation increasing directly with said discharge velocity.

18. The apparatus of claim 7 wherein said primary combustion oxygen air stream discharged from said jet has a rate of air mass flow, and said out-of-line fan includes a butterfly valve to vary said rate of air mass flow, said producer having a corresponding rate of producer gas production, said corresponding rate of producer gas production increasing directly with said rate of air mass flow wherein said primary combustion oxygen air stream provides sufficient oxygen for complete combustion of said producer gas.

19. The apparatus of claim 6 wherein said hot jacket extends upwards from said suction chamber to enclose an intermediate portion being positioned above and contiguous with said suction chamber.

20. The apparatus of claim 6 wherein said out-of-line fan includes a needle valve means for adjusting said jet, said needle valve means including a shaft with a pointed end, said pointed end being moveable relative to said jet to very said air stream.

21. In combination with a gas producer, said gas producer being suitable for generating producer gas from organic materials, an apparatus comprising:

a burner means for burning said producer gas to generate heat;

a burner throat means for providing fluid flow communication from said producer to said burner means, said producer gases flowing from said producer through said burner throat means into said burner means;

a large fan;

an air tunnel operationally disposed subsequent said burner means and antecedent said large fan, said air tunnel having an open end and enclosing a portion of said burner means, said enclosed portion having a hot exterior surface and comprising an enclosed heated surface, said air tunnel having a fluid flow, said fluid flow traveling proximate said enclosed heated surface and absorbing heat to comprise a first heated fluid flow, said first heated fluid flow being drawn into an inlet opening of said large fan; said large fan having a discharge side;

a plenum disposed proximate said discharge side of said large fan, said plenum having fluid communication with a grain bin, said large fan discharging a heated discharge fluid flow through said discharge side and into said plenum, said heated discharge fluid flow having a desired temperature; and a temperature control means for regulating said heated discharge fluid flow to achieve said desired temperature, said temperature control means including a temperature sensing probe disposed in said plenum and operationally connected to said temperature control means to indicate to said temperature control means whether said heated discharge fluid flow has a temperature below said desired temperature or above said desired temperature.

22. The apparatus of claim 21 wherein said large fan is enclosed within a fan room, and wherein said air tunnel includes a first damper, said first damper providing for fluid communication between said air tunnel and said fan room, said first heated fluid flow flowing from said air tunnel through said first damper and into said large fan within said fan room.

23. The apparatus of claim 22 wherein said first damper has an open position, a closed position and a plurality of intermediate positions intermediate said open and said closed positions, said first damper permitting increasing fluid flow movement as said first damper is moved from said closed position to said open positions; said burner throat means including a heat generation adjustment means, and said burner means having a rate of heat generation, said heat generation adjustment means having an open, a closed and a plurality of intermediate positions, said rate of heat generation increasing as said heat generation adjustment means is moved from said closed to said open positions; said temperature control means being operably connected to said first damper and said heat generation adjustment means; said temperature control means simultaneously moving said first damper and said heat generation adjustment means towards said open positions, respectively, when said temperature sensing probe indicates to said temperature control means that said heated discharge fluid flow has a temperature below said desired temperature; and said temperature control means simultaneously moving said heat generation adjustment means and said first damper towards said closed positions, respectively, when said temperature sensing probe indicates to said temperature control means that said heated discharge fluid flow has a temperature above said desired temperature.

24. The apparatus of claim 23 wherein said fan room includes a supplemental heat source, said supplemental heat source being operationally connected to said temperature control means, said supplemental heat source being activated by said temperature control means to supply supplemental heat to said large fan when said temperature sensing probe indicates to said temperature control means that said heated discharge fluid flow has a temperature below said desired temperature while said heat generation adjustment means and said first damper are in said open positions, respectively.

25. The apparatus of claim 24 wherein said supplemental heat source comprises a gas burner, and wherein said fan room includes a second damper; said gas burner including a throttle valve, and having a rate of supplemental heat generation, said throttle valve having an open, a closed, and a plurality of intermediate positions intermediate said open and closed positions, said temperature control means being operationally connected to said throttle valve to move said throttle valve between said open and closed positions, said rate of supplemental heat generation increasing as said throttle valve is moved from said closed to said open positions respectively; said second damper providing for fluid communication between said fan room ambient air outside of said fan room, said second damper having an open, a closed and a plurality of intermediate positions intermediate said open and closed positions, said temperature control means being operably connected to said second damper to move said second damper between said open and said closed positions, said second damper permitting increasing fluid flow movement as said second damper is moved from said closed to said open position; said temperature control means including a plurality of positioning means to simultaneously move said heat generation adjustment means, said throttle valve, said first damper, and said second damper between said open and said closed positions, respectively, said heat generation adjustment means, said first damper, and said throttle valve being in said open position when said second damper is in said closed position; said temperature control means operating said positioning means to simultaneously move said heat generation adjustment means, said first damper, and said throttle valve towards said open positions respectively, and said second damper towards said closed position when said temperature sensing probe indicates to said temperature control means that said heated discharge fluid flow has a temperature below said desired temperature.

26. The apparatus of claim 25 wherein said gas burner and said second damper supply a variable temperature air flow to said large fan.

27. The apparatus of claim 26 wherein said fan is enclosed by an eccentric housing.

28. The apparatus of claim 27 wherein said burner means has an open upper end, an interior region, and a primary hot combusted gas flow flowing upward in said burner means and being discharged through said open upper end as a stack discharge flow, said enclosed heated surface of said burner means including an opening, said opening facing away from said open end of said air tunnel, said fluid flow through said air tunnel drawing a portion of said primary hot combusted gas flow out of said interior region and through said opening to comprise a furnace opening discharge flow, said furnace opening discharge flow mixing with said first heated fluid flow whereby the temperature of said first heated fluid flow is increased.

29. The apparatus of claim 28 wherein said burner means comprises a multichambered burner, said multichambered burner including an air inlet means for providing excess combustion oxygen, and a pilot means for providing a combustion temperature.

30. The apparatus of claim 29 wherein said producer gas generated in said producer flows upward in said producer through said organic materials and includes distillates which distill out of said organic materials to comprise a producer gas/distillate flow flowing into said burner throat means, said distillates having a condensation temperature; and wherein said burner throat means includes a superheating means for superheating said producer gas/distillate flow to a superheated temperature above said condensation temperature, said superheated producer gas/distillate flow holding a temperature above said condensation temperature while traveling through said burner throat means.

31. The apparatus of claim 30 wherein said superheating means comprises a return gas line, said return gas line providing for fluid communication between said burner means and said burner throat means, a hot combusted gas flow being drawn from said burner means through said hot return gas line and into said burner throat means, wherein said hot combusted gas flow superheats said producer gas/distillate flow.

32. The apparatus of claim 31 wherein said burner throat means has an inlet portion and includes an out-of-line fan, said out-of-line fan including a jet disposed proximate said inlet portion and discharging an air stream from said jet into said burner throat means, said inlet portion comprising a suction chamber, said suction chamber being in fluid communication with said return gas line; said out-of-line fan thereby creating a suction force within said burner throat means.

33. The apparatus of claim 32 wherein said air stream comprises a primary combustion oxygen airstream, said primary combustion oxygen airstream mixing with said superheated producer gas/distillate flow to comprise a superheated combustible mixture, said superheated combustible mixture being burned in said burner means to generate heat and comprise said primary hot combusted gas flow.

34. A method of drying grain, comprising the steps of:

a. burning organic materials in a producer to generate a producer gas/distillate flow;
b. drawing said producer gas/distillate flow through a burner throat means having a superheating means for heating said producer gas/distillate flow to a temperature above a condensation temperature, and delivering said superheated producer gas/distillate flow to a burner means at a temperature above said condensation temperature;
c. burning said superheated producer gas/distillate flow in said burner means to generate heat;
d. transmitting heat generated by said burner means to a fluid flow to produce a first heated fluid flow;
e. drawing said first heated fluid flow through a large fan and discharging a heated discharge fluid flow from said large fan into a plenum for distribution to one or more grain bins.

35. The method of claim 34 further comprising the steps of:

a. Sensing the temperature of said heated discharge fluid flow in said plenum;
b. Indicating to a temperature control means whether said heated discharge fluid flow has a temperature above a desired temperature or below said desired temperature;
c. Simultaneously adjusting a rate of heat generation of said burner means and a corresponding rate of first heated air flow into said large fan by means of one or more positioning means operably connected to said temperature control means to achieve said desired temperature in said heated discharge fluid flow in said plenum.

36. The method of claim 35 further comprising the steps of:

operating said positioners to simultaneously increase or decrease a rate of supplemental heat generation from a supplemental heat source, as said rate of heat generation of said burner means and said corresponding rate of first heated air flow are simultaneously increased or decreased, respectively, to produce said desired temperature for said heated discharge fluid flow in said plenum.

37. The method of claim 36 wherein said supplemental heat source is not activated by said temperature control means to produce supplemental heat unless said heated discharge fluid flow in said plenum has a temperature below said desired temperature when said rate of heat generation burner means is at a maximum rate, and said corresponding rate of first heated air flow into said fan is simultaneously at a maximum rate.

38. The method of claim 37 further comprising the step of: providing a variable temperature fluid flow to said large fan by means of said positioners such that as said rate of heat generation of said burner means, said corresponding rate of first heated fluid flow into said large fan, and said rate of suplemental heat generation from said supplemental heat source are simultaneously increased, a rate of variable temperature fluid flow into said fan is simultaneously decreased; and conversely, as said rate of heat generation of said burner means, said corresponding rate of heated air flow, and said second rate of heat generation from said supplemental heat source are simultaneously decreased, said rate of variable temperature fluid flow into said fan is simultaneously increased.

* * * * *